US005713499A

United States Patent [19]

Daniel

[11] Patent Number: 5,713,499

[45] Date of Patent: Feb. 3, 1998

[54] SELF DETACHING RECYCLE BIN AND GARBAGE DRUM ATTACHING DEVICE

[76] Inventor: John Thazhamana Daniel, 9755 Egret Blvd., Coon Rapids, Minn. 55433

[21] Appl. No.: 409,089

[22] Filed: Mar. 23, 1995

Related U.S. Application Data

[63] Continuation-in-part of Ser. No. 305,583, Sep. 14, 1994, abandoned.

[51] Int. Cl.[6] ..... B65D 21/02

[52] U.S. Cl. ..... 224/401; 224/561; 224/564; 220/23.4; 220/908; 248/311.2; 248/312.1; 248/907

[58] Field of Search ..... 224/560, 561, 224/407, 564; 245/311.2, 312.1, 907, 211, 238, 227; 220/751, 742, 743, 737, 23.4, 23.86, 482, 908

[56] References Cited

U.S. PATENT DOCUMENTS 1,353,853 9/1920 Sanberg .
2,116,576 5/1938 Hormann .
2,289,701 7/1942 Engel et al. .
3,490,726 1/1970 Mills .
3,662,982 5/1972 Antonius .
5,108,000 4/1992 Stoll et al. .

*Primary Examiner*—Linda J. Sholl
*Attorney, Agent, or Firm*—Janet Peyton Schafer

[57] ABSTRACT

A device for attaching a smaller container to a larger container which comprises of a base, two vertical hooks at appropriate angle to the base to hold and attach the smaller container to the side of the larger container, two adjustable hooks to hold the smaller container in place, and two legs to support the weight of the smaller container and the device, keep it in place on the side of the larger container and help to keep the smaller container away from the larger container when it detaches from the bracket.

7 Claims, 3 Drawing Sheets

SELF DETACHING RECYCLE BIN AND GARBAGE DRUM ATTACHING DEVICE

This application is a Continuation-In-Part of prior application Ser. No. 08/305,583 filed on Sep. 14. 1994 now abandoned of John T. Daniel for "Recycle Bin and Garbage Drum attaching device".

FIELD OF INVENTION

The invention relates to a self detaching hook up device for attaching a "recycle bin" to a "garbage drum" with wheels for the ease and convenience of taking out both together.

DESCRIPTION OF PRIOR ART

People use drums with wheels to collect and take out domestic waste (garbage). Recycle waste is usually collected in rectangular bins. People wheel the "garbage" drum to the curb for pick up. Recycle bins are usually without wheels and so are lifted and carried to the curb. The difficulty in this is that:

1. Two trips are needed; one for the garbage drum and another for recycle bin. (If you drive around on a "garbage day" you will see the recycle bin is missing in many homes. One of the reasons is that in the busy morning, they had no time to make two trips so they usually empty the recycle bin into the garbage drum to save time.)

2. Lifting and carrying the recycle bin can make your clothes get dirty. (Garbage is taken out usually just before leaving for work.)

3. For the elderly and people with back problems, bending over and lifting the recycle waste bin is not an easy task.

This invention eliminates these difficulties and makes the job easier, thereby encouraging recycling activity. As the recycle bin detaches itself, there is no fear of leaving the recycle bin hooked on to the garbage drum interfering with the automatic loading system used by most waste haulers.

OBJECTS AND ADVANTAGES

The invention is a device in which a recycle bin can be hooked onto a bracket or rod mounted on the side of a wheeled garbage drum. This invention makes the work of taking out the recycling bin easy and allows for easy pickup by recycling haulers. When using this device there is no need to lift the recycle waste bin. This recycle bin can be hooked onto the garbage drum by slightly tilting the bracket mounted recycle bin, shown at FIGS. 4–7. This is especially useful for people with back. The supporting legs keep the bin in place when the bin is hooked onto the garbage drum preventing the bin from sliding sideways while wheeling the garbage drum to the curb. The legs are also designed in such a way that the recycle bin can be pushed away from the garbage drum after it is unhooked. The bracket or rod is positioned such that the bottom of the recycle bin hangs lower than the bottom of the garbage drum. This allows the recycle bin to be automatically unhooked when the garbage drum sits straight on the ground. The legs of the device pushes the recycle bin away from the garbage drum so there is no danger of leaving the recycle bin remaining hooked onto the garbage drum.

BRIEF DESCRIPTION OF DRAWINGS

Understanding of the invention will be enhanced by referring to the accompanying drawings, in which like numbers refer to like parts in the several views and in which.

DESCRIPTION OF OPERATION

Understanding of the invention will be further enhanced by referring to the following illustrative but nonlimiting example.

Figure 1:
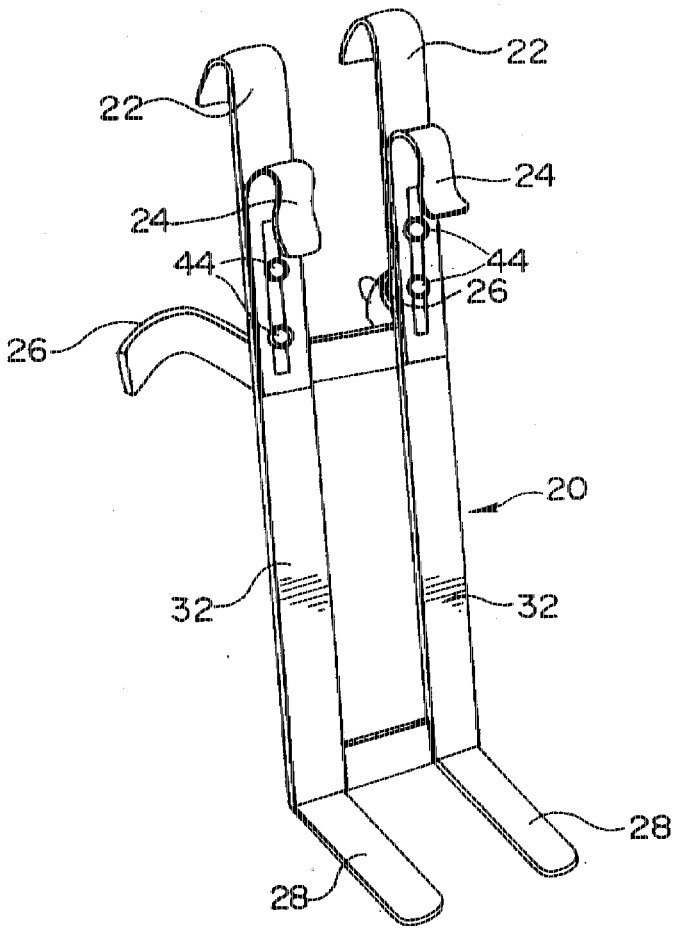
FIG. 1 shows the perspective view of the device.
Figure 3:
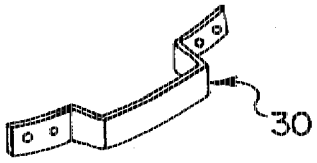
FIG. 3 is the bracket.
Figure 4:
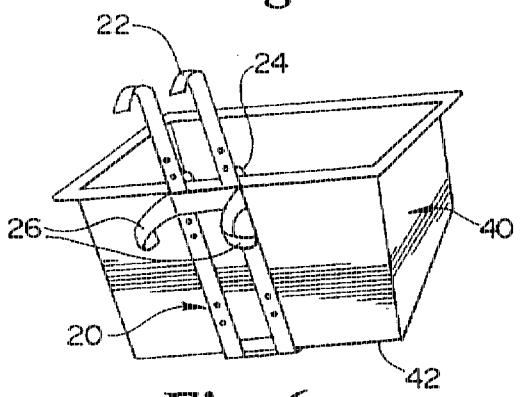
FIG. 4 shows the device attached to a recycle bin.
Figure 5:
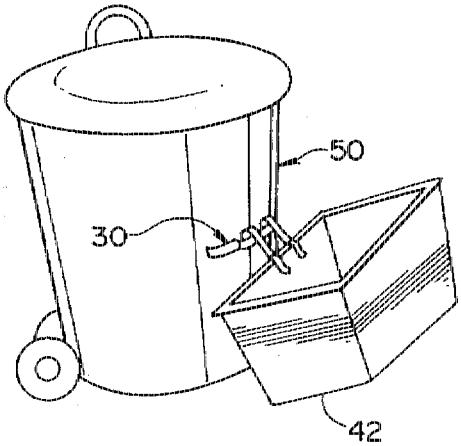
FIG. 5 shows tilting and hooking the recycle bin onto a garbage drum.
Figure 6:
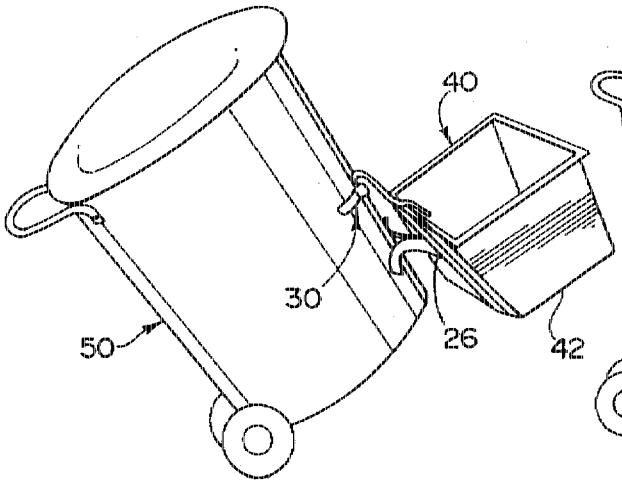
FIG. 6 shows the garbage drum and recycle bin in position for wheeling to the site of garbage pickup.
Figure 7:
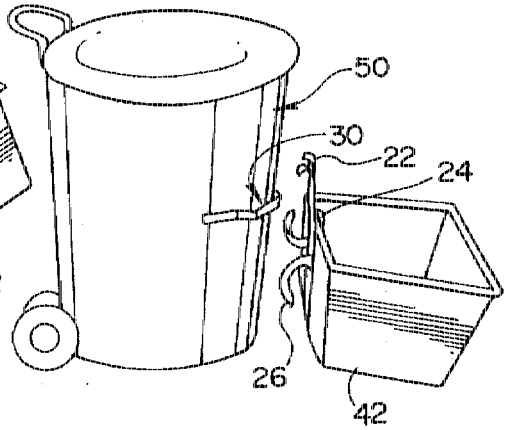
FIG. 7 shows the recycle bin detached as the drum and bin sit straight.
Figure 8:
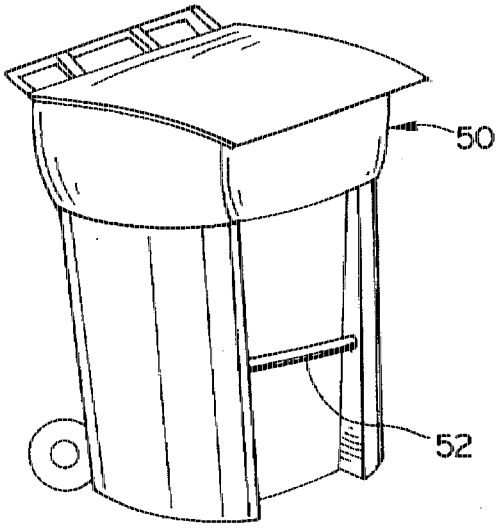
FIG. 8 shows a garbage drum with built in rod.

Turning now to the drawings, which describe the presently preferred embodiments of the invention for the purpose of illustrating the practice thereof and not by way of limitation of the scope of the invention, and in which like reference characters refer to corresponding elements throughout the several views, FIG. 1 shows an embodiment of the self detaching garbage drum and recycle bin attaching device 20. The device 20 is attached to the recycle bin 40 as shown in FIG. 4. FIG. 3 shows the bracket 30. The bracket 30 is attached to the garbage drum 50. Some drums 50 don't need a bracket 30 as it has a rod 52 built into the drum 50 as shown in FIG. 8. Prongs 28, as shown in FIG. 1, extend from the support members 32 to support the base 42 of the recycling bin 40, shown in FIG. 4. Prongs 28 are slipped under the recycle bin 40. The user uses the adjustable hooks 24 to fasten the recycle bin 40 tight and firm in place on the garbage drum 50. The device 20 stays with the bin 40 all the time. When taking waste out, tilt the bin 40 and hook it, by means of adjustable hooks 22 to the bracket 30 or rod 52 on the side of the garbage drum 50, as shown in FIGS. 5 & 6. The legs 26 aid the bin 40 to stay straight and support it from the side of the drum 50. This will also prevent the bin 40 from sliding sideways. The legs 26 are shaped such a way as to stay properly on a curved or flat surface as the case may be. Then the user wheels the drum 50 along with the bin 40 to the curb, or other site, (as shown in FIG. 6) for waste to be picked up. On reaching the curb when the garbage drum 50 is allowed to sit straight, the recycle bin 40 automatically detaches itself from the garbage drum 50 as shown in FIG. 7. This happens because the recycle bin 40 hangs little lower than the bottom of the garbage drum 50 and also because the legs 26 are so designed to keep the recycle bin 40 away from the garbage drum 50.

All embodiment of this invention would function to attach a recycle bin 40 to a garbage drum 50 and keep it in place while moving the drum 50. The device 20 also functions to automatically detach the recycle bin 40 from the garbage drum 50 when the garbage drum 50 sits straight.

Figure 9:
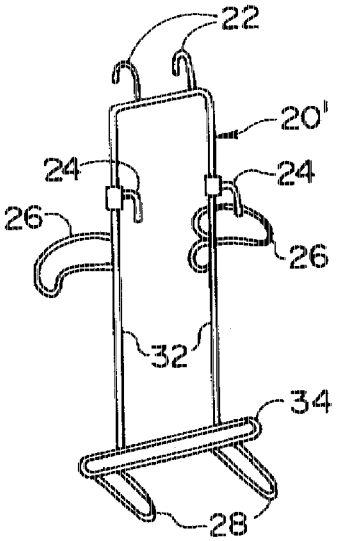
FIG. 9 is a second embodiment of the device of FIG. 1.
Figure 10:
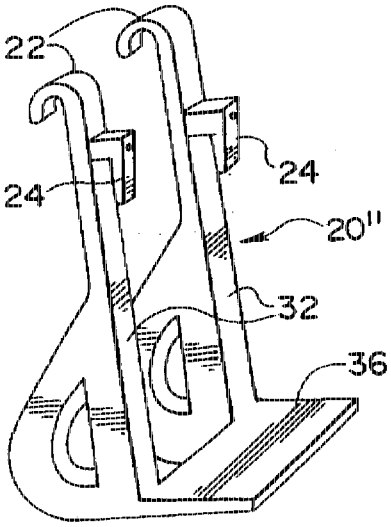
FIG. 10 is a third embodiment of the device of FIG. 1.
Figure 11:
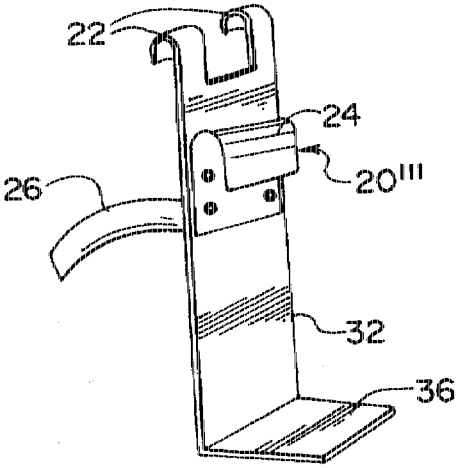
FIG. 11 is a fourth embodiment of the device of FIG. 1.

The device also can have different embodiments as shown in FIG. 9 and FIG. 10 and 11. FIG. 9 shows the second embodiment 20' made out of strong metal wire. FIG. 10 shows the third embodiment 20" that can be made by injection molding using suitable kinds of plastics. FIG. 11 shows the a fourth embodiment 20'" of one piece construction made out of sheet metal, although other materials having similar characteristics of being resilient and noncorroding could be used.

The second embodiment 20' has a base 34 to which is support members 32 and prongs 28 are attached, as shown in FIG. 9. The third embodiment 20" replaces the prongs 28 of the first two embodiments with a shelf 36, as shown in FIG. 10. The fourth embodiment 20'" has a single support member 32 from which a shelf 36 is attached in a generally perpendicular position relative to the support member 32, shown at FIG. 11.

Figure 2:
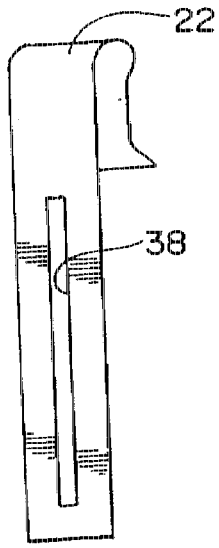
FIG. 2 shows the back view of the adjustable hook that keeps the bin in place.

Adjustable hook 22, shown at FIG. 2, has retained therein a slot 38 for receipt of a fastener 44, as shown in FIG. 1, for receipt of and holding fast a recycling bin 40 of a variety of heights, in the manner shown in FIGS. 5, 6, and 7.

I claim:

1. A self-detaching device for attaching a smaller container with a bottom to a larger container with a bottom which comprises:

a) a base that supports the smaller container from the bottom;

b) two vertical hooks interconnected at a generally vertical angle with the base to hook the smaller container to the larger container and support the smaller container in hanging by the side of the larger container;

c) two shorter adjustable hooks which are fastened to the said vertical hooks, and interconnected to the base, to hold the smaller container in place;

d) two legs, interconnected to the base, shaped and positioned in such a way as to keep the smaller container in place on the side of the larger container and help the smaller container to stay away from the larger container when the smaller container detaches from the larger container;

e) a bracket adapted to be attached to the side of the larger container;

f) said bracket and said two vertical hooks adapted to be releasably connected for allowing the smaller container to be hung from the larger container in such a manner that the bottom of the smaller container is in a plane below the plane of the bottom of the larger container when the larger container is in a tilted position relative to the ground;

g) means for detaching the vertical hooks from the bracket when said larger container is moved from the tilted position to a position where the entire bottom of the larger container is in contact with the ground.

2. A self-detaching recycling bin attaching device, comprising:

a) a support member;

b) means attached to the support member to support the bottom of a recycling bin;

c) a garbage drum with a bottom for releasably attaching the support member thereto;

d) at least one hook attached at a first end of the support member at a generally vertical angle, for releasably attaching the device to the garbage drum;

e) at least one shorter adjustable hook, adjustably mounted to the support member for holding the recycling bin in place on the support member;

f) means for mounting the at least one hook to the garbage drum;

g) said means for mounting and said at least one hook adapted to be releasably connected for allowing the recycling bin to be hung from the garbage drum in such a manner that the bottom of the recycling bin is in a plane below the plane of the bottom of the garbage drum when the garbage drum is in a tilted position relative to the ground;

h) means for detaching the vertical hooks from the means for mounting when said garbage drum is moved from the tilted position to a position where the entire bottom of the garbage drum is in contact with the ground.

3. The device of claim 2, wherein the means to support the bottom of the recycling bin further comprises a pair of prongs.

4. The device of claim 2, wherein the means to support the bottom of the recycling bin further comprises a shelf.

5. The device of claim 2, wherein the means for mounting further comprises a bracket affixed to one side of the garbage drum.

6. The device of claim 2, wherein the means for mounting further comprises a rod built into a side of the garbage drum.

7. A method of using the device of claim 2, comprising the steps of:

positioning the recycling bin on the garbage drum by securing the recycling bin to the support member by said at least one shorter adjustable hook and said means attached to the support member to support the bottom of a recycling bin;

attaching the support member to the means for mounting by said at least one hook such that the bottom of the recycling bin hangs below the bottom of the garbage drum in a tilted position relation relative to the ground;

and moving the garbage drum from the tilted position to a position where the entire bottom of the garbage drum is in contact with the ground thereby dislodging the recycling bin from attachment to the garbage drum.

* * * * *